United States Patent [19]

Meunier

[11] Patent Number: 4,575,450

[45] Date of Patent: Mar. 11, 1986

[54] PROCESS FOR OBTAINING EXTRUDED SEMIFINISHED PRODUCTS FROM HIGH RESISTANCE ALUMINUM ALLOY POWDER

[75] Inventor: Jean Meunier, Grenoble, France

[73] Assignee: Pechiney, France

[21] Appl. No.: 570,257

[22] Filed: Jan. 12, 1984

[30] Foreign Application Priority Data

Jul. 21, 1983 [FR] France ..... 83 12381

[51] Int. Cl.[4] ..... B22F 1/00; C22F 1/10

[52] U.S. Cl. ..... 419/41; 419/48; 419/67

[58] Field of Search ..... 419/48, 41, 67

[56] References Cited

U.S. PATENT DOCUMENTS

| | | | |
|---|---|---|---|
| 3,664,008 | 5/1972 | Haller | 419/48 |
| 3,954,458 | 5/1976 | Roberts | 419/48 |
| 4,110,131 | 8/1978 | Gessinger | 419/41 |
| 4,460,541 | 7/1984 | Singleton et al. | 419/48 |
| 4,464,199 | 8/1984 | Hildeman et al. | 419/48 |

FOREIGN PATENT DOCUMENTS

| | | | |
|---|---|---|---|
| 879590 | 10/1961 | United Kingdom | 419/41 |

*Primary Examiner*—Allan M. Lieberman

*Attorney, Agent, or Firm*—Oblon, Fisher, Spivak, McClelland & Maier

[57] ABSTRACT

This invention relates to a process for obtaining extruded semifinished products from high resistance aluminum alloy powder.

It is characterized in that there is used particularly a powder of an aluminum-lithium alloy obtained by atomization in a neutral gas. This powder is loaded in a jacket of aluminum alloy of the 5000 type, then hot degassed under a pressure less than the atmospheric pressure; after sealing of the jacket, the unit is subjected to hot inverted extrusion and heat treated in the ambient air.

The plated composite semifinished product thus obtained exhibits a very high resistance and finds its application particularly in the aeronautical industry.

14 Claims, 2 Drawing Figures

Figure 1:
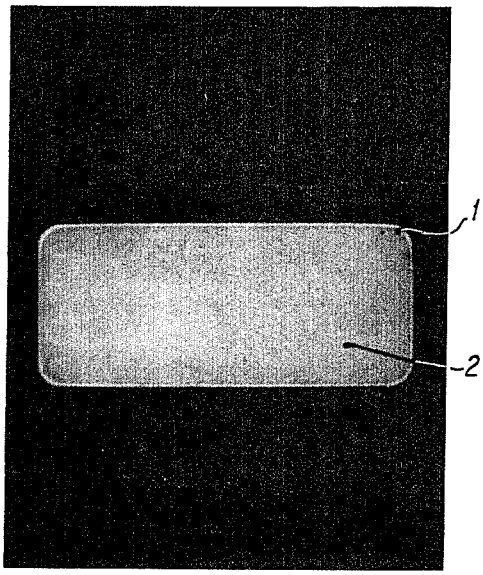

PROCESS FOR OBTAINING EXTRUDED SEMIFINISHED PRODUCTS FROM HIGH RESISTANCE ALUMINUM ALLOY POWDER

This invention relates to a process for producing, from high resistance aluminum alloy powder, extruded semifinished products intended particularly for applications in the aeronautical industry.

In the field of aluminum, the production of extruded semifinished products can call for, in an initial phase, either casting processes or processes for pressing of powders. The choice between either of these processes is made mainly as a function of the composition of the alloy used and the mechanical properties desired for the semifinished product.

It would be desirable to be able extrude aluminum alloys to obtain semifinished products intended particularly for aeronautics which have a relatively high breaking strength, generally greater than 500 MPa, and a suitable elongation at least equal to 5%.

These properties can be achieved by using, either alloys which, according to the standards of the Aluminium Association, belong to the 7000 series, particularly the 7090 and 7091 alloys, or more recently alloys of the lithium family, such as those which contain particularly 2 to 3% lithium and other addition elements such as copper, magnesium, zinc or zirconium.

However, the standard processes mentioned above are poorly suited to these alloys.

Actually, if the operation is by casting, there is generally obtained a strong segregation of the cast product which then exhibits a great tendency to crack, hence a prohibitive reject rate of the parts thus made. As for the extruded semifinished products which result from it, their structure with coarse grains and rough phases make them particularly fragile. These many drawbacks make this process unsuitable for the desired purpose.

If powder metallurgy processes are resorted to, especially with lithium alloys, because this element has a very great chemical reactivity, a problem of pollution of the environment is encountered. Of course, this difficulty can be eliminated by temporarily protecting the powder from the outside environment by a jacket, for example, until it has been densified by pressing and sintering. Thus, an effort has been made to apply the following known process comprising the stages of:

- spraying of the alloy by atomization,
- pressing of the powder into the shape of a blank,
- putting the blank under a jacket,
- hot degassing of the blank under reduced pressure and sealing of the jacket,
- hot pressing of the unit in a mold and sintering of the powder,
- machining of the jacket to separate it from the blank,
- hot extruding the sintered blank and,
- applying heat treatments, optionally putting into solution and of necessary aging to attain the required properties.

But this process, besides the fact that it comprises a series of numerous and relatively complex operations, also exhibits other drawbacks. Thus, when use of powders very sensitive to the environment is involved, the powders cannot be made in the standard way by atomization in the air because they would oxidize producing products with unsuitable mechanical properties. Therefore, it is necessary to resort to neutral gas atmospheres such as helium, preferably.

Under these atomizing conditions, the powder obtained then exhibits a particular morphology with spherical grains. These grains have the disadvantage of being poorly suited to pressing and give rise to the formation of blanks with poor mechanical quality which tend to flake away.

Of course, the pressing rate of the powder could be increased to prevent this drawback, but the possibilities of subsequent hot degassing of the blank would be reduced and thus the quality of the final product would be impaired. For this reason, this cold pressing rate must be limited so that before and during the covering with a jacket, and in any case until they have been 100% densified, these blanks have the possibility of reacting with the surrounding environment and, particularly, up picking of moisture from the air, which further causes an oxidation of the alloy and the formation of hydrogen within the blank. This hydrogen will bring about the presence, in the semifinished products that result from extrusion of these blanks, of porosities very prejudicial to the desired high resistance.

Moreover, the presence of this gas and other products of the reaction with the environment will limit the sintering rate and prevent attaining a suitable final densification during the hot pressing operation. For this reason, it is imperative to perform a thorough degassing of the blank.

Nevertheless, under the conditions of the process mentioned above, and by taking all precautions to achieve a good degassing, it is found in the majority of cases that after hot pressing and sintering of the blank within the jacket, then removal of the jacket, the product obtained extrudes poorly and leads to cracked semifinished products on which local losses of cohesion appear.

To a certain extent, these defects can be avoided by acting on the extrusion temperature, the nature of the machining or even by reducing the extrusion speed, but then this is to the detriment of the economy of the process.

Further, in the case of aluminum-lithium alloys, it is necessary to take precautions during the heat treatments intended to improve their mechanical properties because of their sensitivity to the environment. In particular, these treatments cannot be performed in furnaces with ambient air.

In view of the difficulties inherent in this process of the prior art, but wanting nevertheless to enjoy the advantages of powder metallurgy, the applicant has sought to modify it so as to better adapt it to the problem presented. In particular, the applicant has wanted, by simplifying the process, to facilitate the hot degassing of the powder, improve the extrusion conditions to prevent cracks and losses of cohesion and make heat treatments possible without any particular precautions.

The applicant has thus succeeded in obtaining extruded semifinished products in the shape of plated composites in which the core of high resistance alloy, initially powder, was constantly protected during its shaping from the polluting action of the environment by an airtight jacket, which gives a sound structure devoid of any porosity and of high resistance, and where said core is in close contact with a jacket which faithfully assumes the shape of the die which gives the composite a compact structure with regular geometry.

This process is characterized in that the powder is loaded in a jacket of aluminum alloy, the powder is hot degassed under a pressure less than the atmospheric pressure, the jacket is sealed, the unit is subjected to hot inverted extrusion and heat treated in the ambient air.

The alloy powder used is obtained by atomization in a neutral gas, preferably helium, and optionally by atomization in air in the case of alloys of the 7000 series.

Preferably, this powder has a granulometry less than 400 μm so as to obtain a suitable semifinished product. It is loaded directly into the jacket at the output of the atomizer loose without prior pressing so that the cold pressing phase provided in the prior process is thus avoided. By simplifying the process, this has the advantage of eliminating the problems inherent in the pollution of the powder during this operation and of facilitating the later degassing. However, for certain low density powders, obtained from alloys of the 7000 series atomized in the air, a cold pressing of the powder can be performed before loading it in the jacket.

The jacket used is of an aluminum alloy that lends itself well to deformation during the extrusion operation. This can be an alloy of the 5000 series and, preferably, an A-G3 or an A-G5. The jacket has the shape of a closed cylindrical box, equipped on one of its heads with an appendage intended for filling and later degassing. This jacket has a thickness on the order of a few millimeters which varies according to its diameter.

After loading, the contents of the jacket are connected to a gas pumping device by the appendage and under its action, there is established and maintained a pressure lower than the atmospheric pressure and in any case lower than $1.10^{-3}$ torr while bringing the jacket and its contents to a temperature between 350° and 550° C.

Under these conditions, the degassing of the high resistance alloy is performed completely without being impeded by the brakings, which resulted in the process of the prior art, of the passage of the gas between grains of powder pressed against each other because of the initial cold pressing.

The jacket is then sealed in an airtight manner by suitable means and subjected directly to an inverted extrusion operation at a temperature between 350° and 500° C.

Thus, the steps of the prior art consisting of hot pressing and sintering the powder in a mold before machining of the jacket and extrusion is eliminated.

Surprisingly, it is then found that the semifinished product obtained is compact and exhibits a continuous regular plating in close contact with the underlying powder. But this result can be obtained only by inverted extrusion.

Actually, it is known that there are two main types of extrusion: direct extrusion and inverted extrusion.

In direct extrusion, the metal is pushed by a ram along the container of the press, through a stationary die which determines the shape of the semifinished product.

If this type of extrusion is applied to the hot pressed blank of the prior art, considerable friction of the metal on the wall of the container is produced which causes the appearance of cracks and local losses of cohesion which were mentioned above. On the other hand, if the jacket-container unit according to the invention is subjected to direct extrusion, the jacket serves as a lubricant and reduces the friction of the product with the container. However, this jacket tears and penetrates inside the powder so that the extruded semifinished product obtained exhibits a discontinuous plating with jacket inclusions in the core which eliminates any later protection against the environment and prevents the obtaining of a high resistance.

In inverted extrusion, the die is fastened on the ram and the metal extrudes in a direction opposite to that of the advance of the ram.

When this type of extrusion is applied to the jacketed powder, it is found that the densification of the powder is correctly performed, that the jacket does not undergo any deformation detrimental to the airtightness of the underlying pressed powder, i.e., it does not tear, nor does it penetrate inside the compacted powder, but forms a regular plating in close contact with the entire periphery of the high resistance alloy so that there results from it a semifinished product with suitable integrity that completely assumes the shape of the die used and particularly not susceptible to the attacks of the environment. Moreover, the "lubricating" action of the jacket eliminates any friction of the powder with the die, so that extrusion speeds ordinarily used in the prior art can be considerably increased and speeds greater than the ones obtained during the extrusion of products cast of hard alloys can be attained without risk of loss of cohesion on the surface of the grains of powder insufficiently sintered such as was the case with the products obtained in the prior art by extrusion after hot pressing.

This plated composite semifinished product then lends itself well to the heat treatment operations, placing in solution at 530° C. made generally on the lithium alloys and aging for 6 to 10 hours between 150° and 200° C. in standard air furnaces without it being necessary to take particular precautions since the airtight jacket carries out a protective role in relation to the environment.

The drawings which accompany this application relate to 50×22 mm flats, extruded from powders of Al-Li-Cu-Mg-Zr alloys with a jacket of A-G3 according to the process of the invention. They show a cross section of the flat in FIG. 1 and a longitudinal section of the flat in FIG. 2.

Figure 2:
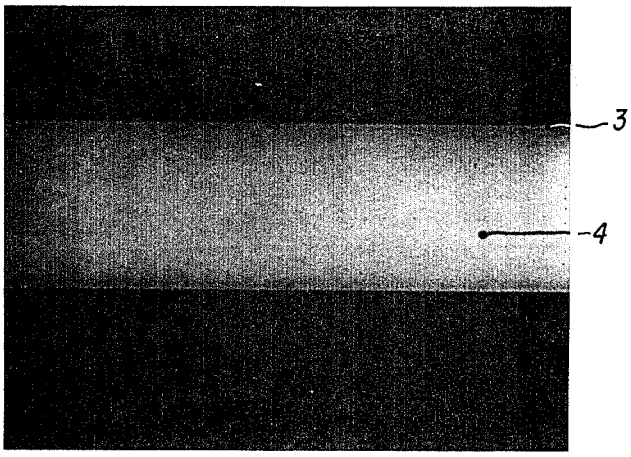

In FIG. 1, it can be found that the jacket (1) is placed regularly all around the compacted part (2) and does not exhibit any local separation. Also, in FIG. 2, in addition to the regularity of the plating (3) around the core (4), a perfect integrity of the shape can also be noted.

This invention finds application in the production of semifinished products having a great mechanical resistance, a suitable elongation and a good stability in the environment, properties which make them particularly suited to applications in the aeronautical industry.

What is claimed as new and desired to be secured by Letters Patent of the United States is:

1. A process for producing extruded semi-finished products from a high resistance aluminum alloy powder which comprises:

(a) hot degassing said powder, produced by atomization in an inert gas, in a jacket of aluminum alloy which is capable of deformation during extrusion, at a pressure of less than $1\times10^{-3}$ torr and at a temperature of between 350° and 500° C., (b) sealing said jacket in an air-tight manner, (c) directly subjecting the sealed jacket to hot inverted-extrusion at a temperature betwen 350° and 500° C. to form a semi-finished product and (d) heat treating the formed semi-finished product.

2. Process as in claim 1, wherein the powder has a granulometry less than 400 μm.

3. The process as in claim 1, wherein the powder aluminum alloy is selected from the group consisting of the 7000 series.

4. The process as in claim 3, wherein the powder aluminum alloy is selected from the group consisting of 7090 and 7091 alloys.

5. The process as in claim 1, wherein the powder aluminum alloy contains lithium.

6. The process as in claim 5, wherein the powder aluminum alloy contains 2 to 3% lithium.

7. The process as in claim 5, wherein the powder aluminum alloy contains at least one of the elements selected from the group consisting of copper, magnesium, zinc and zirconium.

8. The process as in claim 3, wherein the powder is precompacted cold before loading in the jacket.

9. The process as in claim 1, wherein the inert gas is helium.

10. The process as in claim 1, wherein the jacket is of aluminum alloy selected from the group consisting of the 5000 series.

11. The process as in claim 10, wherein the jacket is selected from the group consisting of the A-G3s and the A-G5s of the 5000 series has been.

12. The process as in claim 1, wherein extrusion is effected at a speed greater than that of the products cast of hard alloys.

13. The process as in claim 5, wherein the extruded product is subjected to a treatment of being placed in solution at 500° C. in the ambient air.

14. The process as in claim 1, wherein the extruded product is subjected to an aging process between 150° and 200° C. for 6 to 10 hours.

* * * * *